United States Patent [19]

Sato

[11] Patent Number: 4,531,049

[45] Date of Patent: Jul. 23, 1985

[54] HEATING WIRE

[75] Inventor: Shunichi Sato, Sakodo, Japan

[73] Assignee: Junkosha Co., Ltd., Tokyo, Japan

[21] Appl. No.: 670,540

[22] Filed: Nov. 13, 1984

[30] Foreign Application Priority Data

Nov. 18, 1983 [JP] Japan ..... 58-218476

[51] Int. Cl.[3] ..... H05B 3/54

[52] U.S. Cl. ..... 219/549; 174/88 C; 219/528; 219/541; 219/544; 338/214; 338/273

[58] Field of Search ..... 219/528, 541, 542, 544, 219/549; 338/214, 271, 272, 273, 274; 174/84 R, 88 R, 88 C

[56] References Cited

U.S. PATENT DOCUMENTS

| | | | |
|---|---|---|---|
| 2,780,704 | 2/1957 | Charbonneau | 338/274 X |
| 2,879,364 | 3/1959 | Mucher | 338/214 X |
| 2,970,184 | 1/1961 | Blonder | 174/88 C |
| 3,010,183 | 11/1961 | Forney, Jr. | 174/88 C X |
| 3,045,102 | 7/1962 | Fessenden | 219/549 X |
| 3,593,002 | 7/1971 | Hebert | 219/541 |
| 3,691,505 | 9/1972 | Graves | 338/214 |
| 3,719,799 | 3/1973 | Takayasu | 219/544 X |

FOREIGN PATENT DOCUMENTS

| | | | |
|---|---|---|---|
| 651113 | 10/1962 | Canada | 219/541 |
| 2312911 | 1/1977 | France | 219/541 |

*Primary Examiner*—Volodymyr Y. Mayewsky
*Attorney, Agent, or Firm*—Mortenson & Uebler

[57] ABSTRACT

A heating electric wire is provided having a heating portion electrically connected to a lead portion, the heating portion being a bundle of a plurality of elongate, electrically insulating tension members having a heating layer around the periphery of the bundle of tension members, the lead portion being a bundle of a plurality of elongate, electrical conducting wires, at least a portion of the insulating tension members being coupled to at least a portion of the conducting wires in the connection region between the heating and lead portions, the entire assembly having a heat resistant sheath around its periphery.

7 Claims, 7 Drawing Figures

Fig.1(PriorArt)
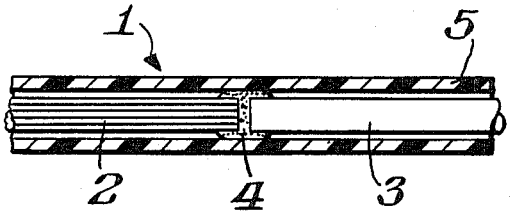
Fig.2(PriorArt)
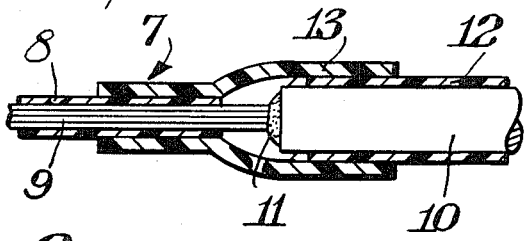
Fig.3.
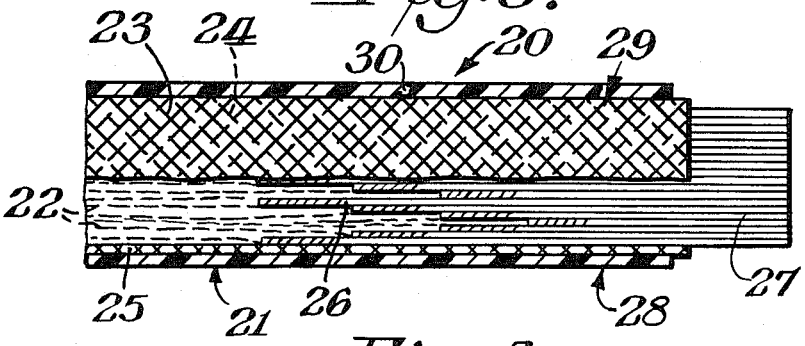
Fig.4.
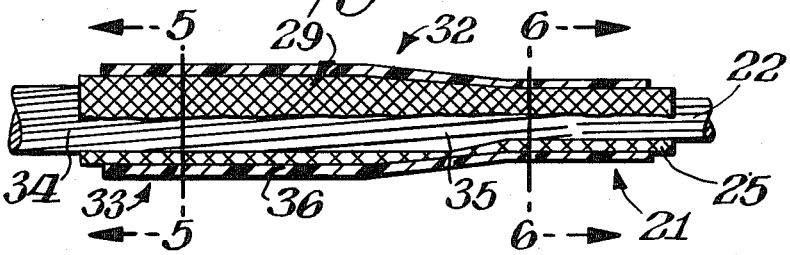
Fig.5.
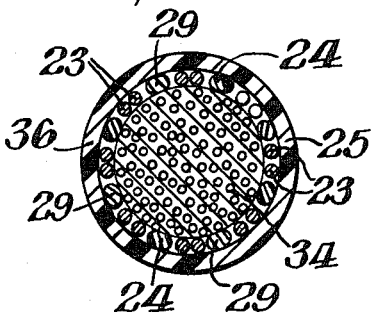
Fig.6.
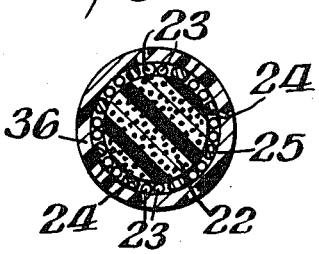
Fig.7.
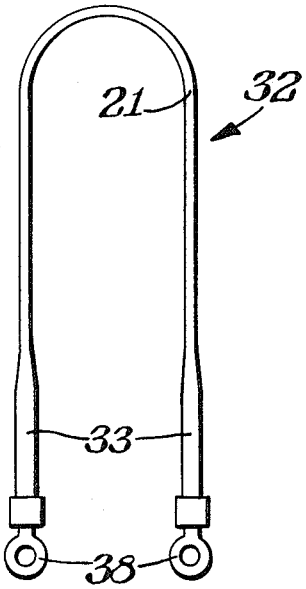

HEATING WIRE

BACKGROUND OF THE INVENTION

This invention relates to a highly flexible, corrosion resistant heating electric wire with exceptional qualities and long useful life.

Heating electric wires generally comprises heat resistant conductors wherein the conductors and leads are soldered together. For this reason, they lack flexibility and are disadvantageous in that connections between heaters and leads can be broken and tend to become defective.

An object of the present invention is to provide a heating electric wire free from trouble caused by the broken connection between the heating section and lead and having longer life and greater flexibility than conventional wires.

SUMMARY OF THE INVENTION

A heating electric wire is provided comprising a heating portion, a connecting portion in which the heating portion is electrically and mechanically connected to a lead portion, the heating portion being a bundle of a plurality of elongate, electrically insulating tension members and having a heating layer around the periphery of the bundle of tension members, the lead portion being bundle of a plurality of elongate, electrical conducting wires, at least a portion of the insulating tension members being connected to at least a portion of the conducting wires in the connecting portion, the entire assembly having a heat resistant sheath around its periphery. The heating layer can comprise a resistant heating conductor wire wound about the periphery of the bundle of tension members and electrically connected to the lead portion or it may be a braid of conductor wires about the periphery of the bundle of tension members and electrically connected to the lead portion. The heating layer may contain a heat insulating line to enable regulation of caloric power. The tension members are selected from the group consisting of expanded, porous polytetrafluoroethylene, polyimide or silicone strands with strands of expanded, porous, sintered polytetrafluoroethylene being preferred. The heat resistant sheath is preferably a fluorocarbon resin sheath.

BRIEF DESCRIPTION OF THE DRAWINGS

FIG. 1 is a side cross-sectional view of part of a conventional heating wire.

FIG. 2 is a side cross-sectional view of part of an alternative conventional heating wire having a larger diameter lead wire capable of supplying a large current.

FIG. 3 is a side view, partly broken away and partly in cross-section of part of a heating wire of the present invention in which the heating portion and lead portion have substantially the same outside diameter.

FIG. 4 is a view, partly cross-sectional and partly broken away, of part of a heating wire of the present invention in which the outside diameter of the heating section is smaller than that of the lead section.

FIG. 5 is a cross-sectional view taken along line 5—5 of FIG. 4.

FIG. 6 is a cross-sectional view taken along line 6—6 of FIG. 4.

FIG. 7 is a top plan view illustrating the heating wire of the invention having connecting terminals affixed thereto for actual use.

DETAILED DESCRIPTION OF THE INVENTION AND PREFERRED EMBODIMENTS WITH REFERENCE TO THE DRAWINGS

A heating electric wire is provided having a heating portion electrically connected to a lead portion, the heating portion being a bundle of a plurality of elongate, electrically insulating tension members having a heating layer around the periphery of the bundle of tension members, the lead portion being a bundle of a plurality of elongate, electrical conducting wires, at least a portion of the insulating tension members being coupled to at least a portion of the conducting wires in the connecting region between the heating and lead portions, the entire assembly having a heat resistant sheath around its periphery.

A heating electric wire substantially free from trouble caused by breakage and having a great deal of flexibility without connecting its heating portion and a lead could be provided by employing a plurality of heating conductors, mating the heating conductors with a plurality of heat resistant insulating tension members and thereby substituting the conductor layers such as metal wires for the tension member. The periphery of the heating electric wire could be covered continuously with a corrosion and heat resistant sheath, providing a heating electric wire offering excellent corrosion resistance with prova great deal of flexibility as well as exceptional life.

Because thermal stress applied across the heating section and lead and its sheath could be minimized by allowing the resistance between the heating section and lead section to gradually change, the life of the heating electric wire might be prolonged.

According to the present invention, a heating electric wire is provided comprising a heating layer, a heat resistant, insulating tension member arranged substantially parallel with and internal to the heating layer, a conductor lead coupled to the end of said tension member and electrically substituted for said tension member, and a heat resistant sleeve continuously enclosing the periphery of the combination of said heating layer, tension member and conductor layer.

In the heating electric wire thus constructed, if the position where the tension member is coupled to the conductor lead is gradually changed or if the resistance is allowed to gradually change by incorporating conductors in the heating layer by mixture, thermal stress will be decreased, which is advantageous. Moreover, if the tension member is used as a core material on which the heating layer is wound, the production thereof will readily be simplified.

In the heating electric wire thus constructed, if the conductors forming the lead are arranged intermittently in the longitudinal direction and the length thereof is set to be roughly twice as long as that of a conventional lead, identically rated heating elements having lends may economically be manufactured.

Referring to the drawings, the present invention will be described in detail.

FIG. 1 is a cross-sectional view illustrative of part of a conventional heating electric wire. As shown in FIG. 1, a heating element conductor 2 and a lead 3 in a conventional heating electric wire 1 are coupled together with a metal solder 4 and a heat and corrosion resistant sheath 5 is provided on the periphery thereof.

For such a heating electric wire 1 as the aforementioned, because the outside diameters of the heating conductor 2 and the lead 3 are roughly the same, the heat and corrosion resistant sheathing can be provided continuously. However, the heating electric wire is disadvantageous in that, although it offers corrosion resistance, it lacks flexibility because the connection between the heating element conductor 2 and the lead 3 is easily broken and therefore is unable to supply a large current because of the small lead diameter making the resistant greater.

Because of these disadvantages, an arrangement shown in FIG. 2 has been provided to obtain heating electric wires capable of supplying a larger current.

As shown in FIG. 2, one end of a heating element conductor 9 provided with a heat and corrosion resistant sleeve 8 in a conventional corrosion resistance heating electric wire 7 is coupled to a lead 10 larger in diameter by metal solder 11. A heat and corrosion resistance sleeve 12 is provided on the periphery of the lead 10 and an additional heat and corrosion resistant sleeve 13 is provided on the periphery of the connection so as to cover both the heat and corrosion resistant sleeves 8 and 12. Although this corrosion resistant heating electric wire 7 is capable of supplying a large current, it still is lacking in flexibility and a further disadvantage is that the connection between the lead 10 and the heating element conductor 9 is easily broken and a corrosive liquid may enter between the heat and corrosion resistant sleeve 13 and the sleeves 8 and 12.

As shown in FIGS. 3 to 7, heating electric wires as examples of the present invention are formed to eliminate the existing shortcomings of prior art heating wires.

FIG. 3 shows a vertical section, partly in cross-section and partly broken away, illustrative of part of a heating electric wire 20 wherein the diameters of the heating section and lead are roughly equal.

The heating section 21 of the heating electric wire 20 is formed as a heating layer 25 on the periphery of the tension member 22, the heating layer comprising a thin heating wire 23 formed of a copper nickel alloy wire and the like and a heat resistant insulating line 24 braided together around the tension member 22. The heat resistant insulating line 24 of the heating layer 25 may be present in between the heating wires 23 as a means for regulating caloric power by adjusting short-circuiting intervals. In addition, the heating wire 23 and the heat resistant insulating line 24 may be present in a braided form and then wound about the periphery of the tension member 22. Tension member 22 comprises a bundle of strands or tapes of porous, expanded polytetrafluoroethylene, or polyimide or silicone strands, depending upon caloric power requirements. Preferred are strands of sintered, porous expanded polytetrafluoroethylene.

At the end of the heating section 21 adjacent the lead section 27 thus formed, the ends of the components of the tension member 22 and the conductors 26 are individually and successively coupled together by twisting them, resulting in conductor lead 27 being coupled to and substituted for the tension member 22 to form lead 28.

The individual conductors 26 constituting the conductor lead portion 27 are preferably successively located so that their ends terminate at different longitudinal position, as shown, each where they are coupled to the individual components of tension member 22 in the longitudinal direction, so that the resistance may gradually vary between the lead 28 and the heating section 21 in the longitudinal direction.

It is also preferred that conductors 29 are contained in the heating layer 25 by mixture in this portion with insulating strands 24 to gradually decrease the resistance and finally reduce it to zero in the lead 28.

If the lead 28 thus prepared to gradually decrease the caloric power to prevent thermal stresses from being generated is manufactured in such a manner that it is roughly twice as long as a standard lead and having intermittent longitudinal termination of conductor ends, the continuous production of such leads can be facilitated. On the periphery of the heating electric wire 20 thus obtained is provided a heat and corrosion resistant sleeve 30 to complete its production.

For the material of the heat resistant sleeve 30, use is preferably made of ethylene-perfluoroalkylvinyl-ether tetrafluoride copolymer resin (PFA), ethylene tetrafluoride-propylene hexafluoride copolymer resin (FEP), ethylene tetrafluoride-ethylene copolymer resin (ETFE) and other fluorocarbon resin.

FIG. 3 refers to an example wherein the diameters of the tension member 22 and the conductor lead 27 are roughly the same. Subsequently, reference is made to another example shown in FIG. 4 wherein the diameter of the conductor lead section is larger than that of the tension member.

In FIG. 4, like elements are given like reference characters as in FIG. 3. The heating section 21 of the heating electric wire 32 in this example is provided with a heating layer 25 similar to what is shown in FIG. 3. In this heating layer 25, conductors 29 are contained in the heating section 21 and mixed with non-conducting strands from its end toward lead section 33 to decrease the resistance gradually along the longitudinal direction and restrict the caloric power in lead 33.

Conductor lead 34 is present as the core of the lead 33 and is so selected as to have a cross section larger than that of the tension member 22 and the individual conductors 35 constituting the conductor lead 34 are individually coupled to the components of the tension member 22 at the endmost of the heating section 21 to supply the tension strength required. The lead 33 is arranged to be intermittently present along the heating section 21 similar to the heating wire of FIG. 3. Accordingly, the lead 33 is so prepared as to have a length roughly twice that of a standard lead. There is provided a corrosion resistant sheath about the periphery of the heating electric wire thus obtained by installing a continuous heat resistant sleeve 36 over the heating section 21 and the lead 33.

As shown in FIG. 5 illustrating a cross-sectional view taken along line 5—5 of FIG. 4, the conductors 29 are additionally incorporated in the braid formed with the heating wire 23 and the heat resistant insulating line 24 for the lead 33 of the heating electric wire 32 thus obtained, whereby the heating wire 23 is shortcircuited. As a result, the generation of heat may be reduced or minimized in this portion, which forms a combination of the conductors 34 and lead 33.

On the contrary, as is seen from FIG. 6 illustrating a cross-sectional view taken along line 6—6 of FIG. 4, the braid formed with only the heating wire 23 and heat resistant insulating line 24 is provided in the heating layer 25 on the periphery of the heat resistant insulating tension member 22 for the heating section 21, so that the heating layer 25 may effectively perform the heating function.

The heating electric wire 32 thus constructed, the heating section 21 and lead 33 thereof being alternately continuously prepared, is cut in the middle of each lead portion 33 and terminals 38 are connected to both ends of the product which is usable in such a form as is shown in FIG. 7. It is possible to provide both ends with terminals on condition that the combinations of the heating section 21 and lead 33 are provided in the middle portion without cutting the lead 33 thereat.

The heating electric wire according to the present invention comprising a heating layer, a heat resistant, insulating tension member arranged substantially parallel with said heating layer, a conductor lead coupled to the end of said tension member and electrically substituted for said tension member, and a heat resistant sleeve continuously enclosing the periphery of the combination of said heating layer, tension member and conductor layer, is substantially free from trouble caused by a broken connection between heating and lead sections, and has greater flexibility, exceptional life and excellent corrosion resistance. Moreover, because the heating section and lead section of the heating electric wire can be prepared continuously, economic efficiency in production is possible.

In addition, because the heating section and lead in the heating electric wire according to the present invention are formed in one body, such a heating electric wire can be installed without substantial difficulty and is convenient for users.

Although the heating layer and tension member are coaxially arranged in the combination described, the present invention is not limited to that arrangement and is applicable to various cases wherein, for instance, heating layers and a tension member are piled up into a flat plate or otherwise, or the heating layer and tension member are arranged in the transverse direction.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A heating electric wire comprising a heating portion, a connecting portion in which said heating portion is electrically and mechanically connected to a lead portion, the heating portion being a bundle of a plurality of elongate, electrically insulating tension members having a heating layer around the periphery of said bundle of tension members, the lead portion being a bundle of a plurality of elongate, electrical conducting wires, at least a portion of the insulating tension members being connected to at least a portion of the conducting wires in said connecting portion, the entire assembly having at heat resistant sheath around its periphery.

2. A heating wire of claim 1 wherein said heating layer comprises a resistant heating conductor wire wound about the periphery of the bundle of tension members and electrically connected to said lead portion.

3. The heating wire of claim 1 wherein said heating layer comprises a braid of conductor wires about the periphery of the bundle of tension members and electrically connected to said lead portion.

4. The heating wire of claim 1 wherein said heating layer contains a heat insulating line to enable regulation of caloric power.

5. The heating wire of claim 1 wherein said tension members are selected from the group consisting of expanded, porous polytetrafluoroethylene, polyimide or silicone strands.

6. The heating wire of claim 1 wherein said tension members are strands of expanded, porous, sintered polytetrafluoroethylene.

7. The heating wire of claim 1 wherein said heat resistant sheath is a fluorocarbon resin sheath.

* * * * *

UNITED STATES PATENT AND TRADEMARK OFFICE

CERTIFICATE OF CORRECTION

PATENT NO. : 4,531,049

DATED : July 23, 1985

INVENTOR(S) : Shunichi Sato

It is certified that error appears in the above-identified patent and that said Letters Patent is hereby corrected as shown below:

In column 2, line 33, "prova" should read --a--.

In column 2, line 61, "lends" should read --leads--.

Signed and Sealed this

*Fifteenth* Day of *October 1985*

[SEAL]

*Attest:*

DONALD J. QUIGG

*Attesting Officer*

*Commissioner of Patents and Trademarks—Designate*